US006263520B1

(12) United States Patent
Song

(10) Patent No.: US 6,263,520 B1
(45) Date of Patent: Jul. 24, 2001

(54) WATER DISCHARGING SYSTEM FOR TOILET

(75) Inventor: Kong Seuk Song, Inchon (KR)

(73) Assignee: Shin Woo Watos Co., Ltd., Inchon (KR)

( * ) Notice: Subject to any disclaimer, the term of this patent is extended or adjusted under 35 U.S.C. 154(b) by 0 days.

(21) Appl. No.: 09/444,389

(22) Filed: Nov. 22, 1999

(30) Foreign Application Priority Data

Feb. 4, 1999 (KR) ..... 99-01644
Jul. 16, 1999 (KR) ..... 99-14113

(51) Int. Cl.[7] ..... E03D 1/14
(52) U.S. Cl. ..... 4/325; 4/324; 4/394; 4/403
(58) Field of Search ..... 4/324–327, 394, 4/403

(56) References Cited

U.S. PATENT DOCUMENTS 3,041,630 * 7/1962 Williams ..... 4/326
3,108,286 * 10/1963 Moore ..... 4/325
4,945,578 8/1990 Jomha et al. .
5,157,796 10/1992 Boyer et al. .
5,400,444 3/1995 Boyer et al. .
5,491,848 * 2/1996 Wang ..... 4/324 X
5,524,297 * 6/1996 Harrison ..... 4/325

* cited by examiner

*Primary Examiner*—Gregory L. Huson
*Assistant Examiner*—Kathleen J. Prunner
(74) *Attorney, Agent, or Firm*—Jacobson Holman, PLLC

(57) ABSTRACT

Controlling a volume of water contained in the toilet's water tank by manipulating short or long a drawing line connected to an operating lever, includes an operating part having an operating member connected with the line and either operated short by pressing an auxiliary button along with the operating lever's handle, or operated long by pressing the overall handle without pushing the auxiliary button; a flush valve opening a drain pipe's intake with a buoyancy maintained if a working distance of the line is short; and a buoyancy control part letting the flush valve's upper part communicate with the water tank and closing the valve to remove the buoyancy if the working distance of the line is long. This system is easily installed in a drain pipe of the water tank already provided to the toilet body, and is capable of controlling a volume of water after installation just by turning the operating lever's handle in one direction only, thus attaining an advantageous economical aspect.

7 Claims, 13 Drawing Sheets

WATER DISCHARGING SYSTEM FOR TOILET

BACKGROUND OF THE INVENTION

1. Field of the Invention

The present invention relates to a water discharging system for a toilet. More particularly, it relates to a water control system for a toilet that can selectively control a volume of water that is discharged from the toilet's water tank.

2. Discussion of Related Art

A common-type toilet has a water tank attached to the toilet body's rear and containing a given amount of water to wash away the body's waste matter by means of a flow of the water. In this common-type toilet's water discharging system that forces the water held in the water tank into the toilet bowl, an opening/closing member, used for opening or closing a drain communicating with the water tank, is directly connected to an inner rear end of an operating lever that is provided to the outside of the water tank. As the opening/closing member is opened by manipulating the operating lever, the water held in the water tank is discharged, and the opening/closing member is then closed to receive and hold a given amount of water. However, this water discharging system is designed to discharge all the water contained in the water tank regardless of a kind of the body's waste matter, and uneconomically consumes the same volume of the water when getting rid of urine or feces.

In order to solve this problem, a two-stage drain valve was disclosed in Korea Utility Model Registration Application No. 91-23211, and granted (Utility Model Publication No. 95-6162).

As shown in FIGS. 1 to 4*b*, this conventional valve is designed to control a volume of water that is held in a water tank W by its selective two-stage control system. The valve includes a drain pipe 10 with a guide bar 12 provided to a drain 11's upper section, and an annular packing 13 mounted on an outer surface of drain 11's upper section, protruding outward; a lower opening/closing member 20 with a cover 22 integrally connected to a cylindrical body 21's lower section under guide bar 12, opened downward, and having a bottom closely contacting packing 13's upper surface, an annular packing 23 mounted on an outer surface of body 21's upper section, protruding outward, and an elevating guide stand 24 provided to cover 22's upper section extending upward and having a guide rectangular hole 25 in its middle; and an upper opening/closing member 30 with a cover 32 integrally connected to a cylindrical body 31's lower section over lower opening/closing member 20, opened downward, and having a bottom closely contacting packing 23's upper surface, guide pins 33 inserted in guide rectangular hole 25 of stand 24 at both sides of cover 32's lower section, and a connector 34 projectingly formed on cover 32's one side to be connected with a line L.

A device for operating such a two-stage drain valve for a toilet was disclosed in Korea Utility Model Registration Application No. 95-24958 and granted (Utility Model Registration No. 127590).

This device 40 includes an operating lever 41 having a handle 411 at one side, a fixing hole 412 formed on its inner middle, and a stopper 413 provided in parallel to the middle of its rear; a support member 42 having a catch groove 421 formed by a given angle on one side of its front surface to limit the rotation of operating lever 41, and a bolt 422 with an opened center; an interval maintaining member 47 joined to support member 42's rear and inserted to a water tank W's through hole; a prop member 43 having a receiving hole 431 to be fitted in bolt 422 of support member 42, a support piece 432 bent to the rear at right angles, and a stopping piece 433 laterally extending under support piece 432; and a check nut 44 screwing onto bolt 422 of support member 42 with prop member 43 interposed.

Device 40 also includes a rotary member 45 having a rotary shaft 452 with a hook 451 formed on one end and tightly fitted in operating lever 41's fixing hole 412, a pair of rotation guide bosses 453 each formed on both side walls of the other end bent at right angles, and a jaw 454 formed at its lower section; and an operating member 46 having a pair of connectors 461 formed on one end to be removably connected to rotation guide bosses 453, a support jaw 462 provided to the lower part of connectors 461 to mate with rotary member 45's jaw 454, and a connection hole 463 provided to its rear end.

This device 40 is assembled in order that each front end of operating lever 41 and support member 42 is positioned outside of water tank W, and prop member 43, rotary member 45, and operating member 46 are placed in water tank W, and connection hole 463 of operating member 46 is connected with upper opening/closing member 30 of the two-stage drain valve via line L.

The operation of device 40 is now fully described.

When washing away the body's waste matter such as urine, requiring a small amount of water, referring to FIG. 4*a*, as a user turns handle 411 of operating lever 41 clockwise to turn rotary member 45 provided to operating lever 41 downward, the lower section of operating member 46's front end, connected to rotation guide bosses 453 of rotary member 45, is caught on prop member 43's support piece 432 and rotates upward on rotation guide bosses 453, thus drawing line L connected to operating member 46's connection hole 463. At this point, operating lever 41's stopper 413 is kept in catch groove 421's upper portion, and simultaneously with this, rotary member 45 moved down is caught in prop member 43's stopping piece 433 at its lower section and does not turn any more, thereby moving up only upper opening/closing member 30 of the two-stage drain valve connected with line L.

As upper opening/closing member 30 is vertically guided and moved up, cover 32's bottom, closely contacting the upper surface of lower opening/closing member 20's packing 23, is moved upward to open lower opening/closing member 30's central upper part, and the water held in water tank W is discharged to the toilet bowl through lower opening/closing member 20's middle part and drain 11.

When the level of the discharged water is the same as lower opening/closing member 20's upper surface, upper opening/closing member 30 is moved down, and as the bottom of its cover 32 closely contacts packing 23 of lower opening/closing member 20, the draining stops. Upper member 30, moved up in draining a small mount of water, is operated along guide rectangular hole 25 of elevating guide stand 24 in a range of hole 25's height, thereby not interfering with lower member 20.

In case of getting rid of the body's waste matter such as feces by means of a large volume of water, once a user turns handle 411 of operating lever 41 counterclockwise as depicted in FIG. 4*b*, rotary member 45 of operating lever 41 is turned upward to make stopper 413 of operating lever 41 be kept in catch groove 421's lower portion, and simultaneously with this, rotary member 45 stops rotating. Operating member 46 connected to rotary member 45 is moved in the same direction as rotary member 45 while jaw 454, formed at the other end of rotary member 45, is kept in the bottom of support jaw 462 and maintains the level. As upper opening/closing member 30 of the two-stage drain valve connected to line L is vertically guided and moved up, cover 32's bottom closely contacting packing 23 is moved upward to open the lower opening/closing member's upper part, and guide pins 33 are moved up catching elevating guide stand 24's guide rectangular hole 25. As guide pins 33 are moved up in this manner, lower opening/closing member 20, integrally formed with elevating guide stand 24, is vertically elevated, and moves up cover 22 closely contacting packing 13's upper surface to open drain 11's upper part. Once the upper part of each of lower opening/closing member 20 and drain 11 is opened sequentially, the water held in water tank W is flown into the toilet bowl through drain 11. As the level of the discharged water is the same as drain 11's upper surface, upper opening/closing member 30 is moved down to let cover 32's bottom closely contact packing 13's upper surface, thereby stopping the draining.

However, the above two-stage drain valve is bulky and complicated to increase the production costs, and must be assembled when its water tank is installed into the toilet body. Therefore, in order to provide this drain valve to a conventional toilet's water tank, the overall water tank should be disassembled. In addition, since this valve cannot be made by injection molding until the height of the upper and lower covers that are moved up is determined, the volume of water that drains cannot be controlled in accordance with the conditions of installation of the water tank.

The device for operating the two-stage drain valve is too complicated to assembly, thus increasing the production costs, and in order to select the volume of the water used for getting rid of the body's waste matter, a user has to turn the operating lever clockwise or counterclockwise, which is inconvenient to use.

SUMMARY OF THE INVENTION

Accordingly, an object of the present invention is to provide a water discharging system for a toilet which is of simple structure to be easily installed to a drain pipe of a water tank already provided to the toilet body, and is capable of controlling a volume of water after installation just by turning its operating lever's handle in one direction only.

In order to achieve the above object of the present invention, the present invention provides a water discharging system for a toilet controlling a volume of water contained in the toilet's water tank by manipulating short or long a drawing line connected to an operating lever, including an operating part having an operating member connected with the line and either operated short by pressing an auxiliary button along with the operating lever's handle, or operated long by pressing the overall handle without pushing the auxiliary button; a flush valve opening a drain pipe's intake with a buoyancy maintained if a working distance of the line is short; and a buoyancy control part letting the flush valve's upper part communicate with the water tank and closing the valve to remove the buoyancy if the working distance of the line is long.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

Figure 1:
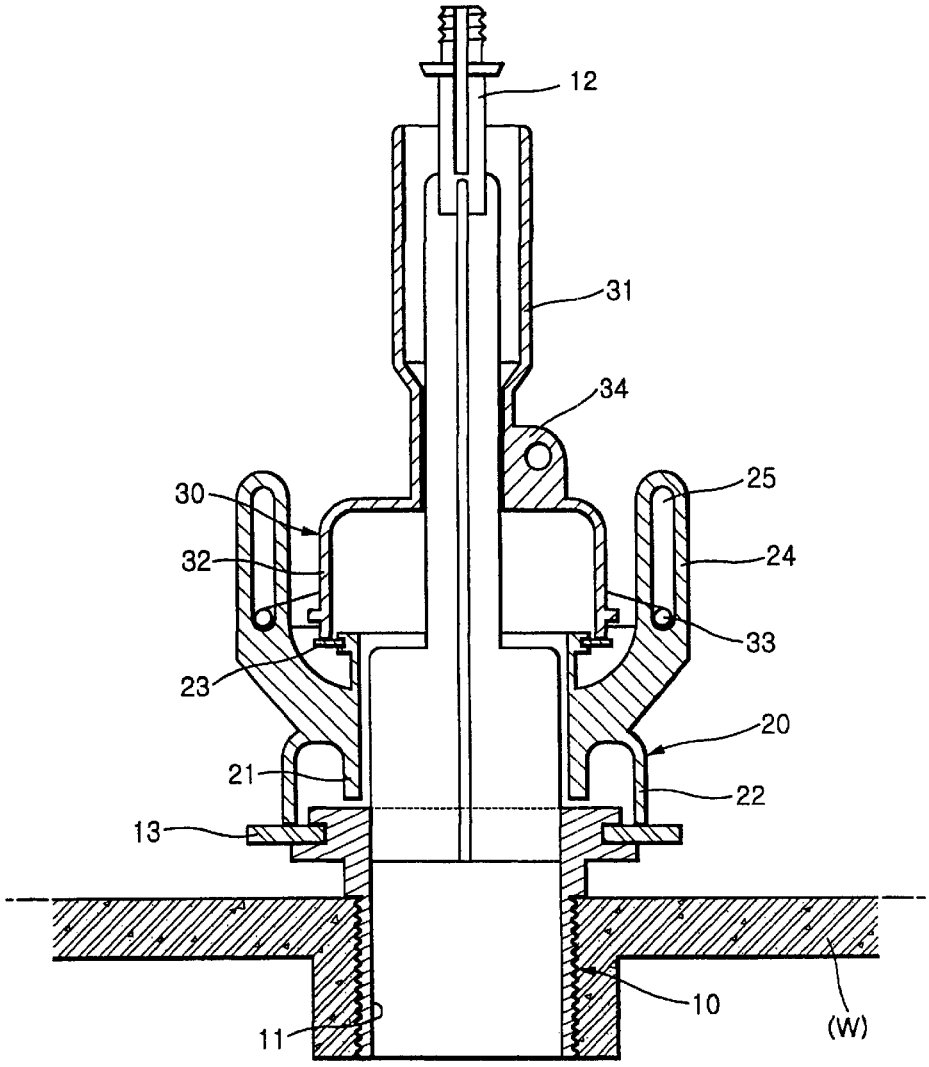
FIG. 1 (PRIOR ART)
FIG. 1 is a sectional view of a two-stage drain valve in accordance with a conventional art.
Figure 2:
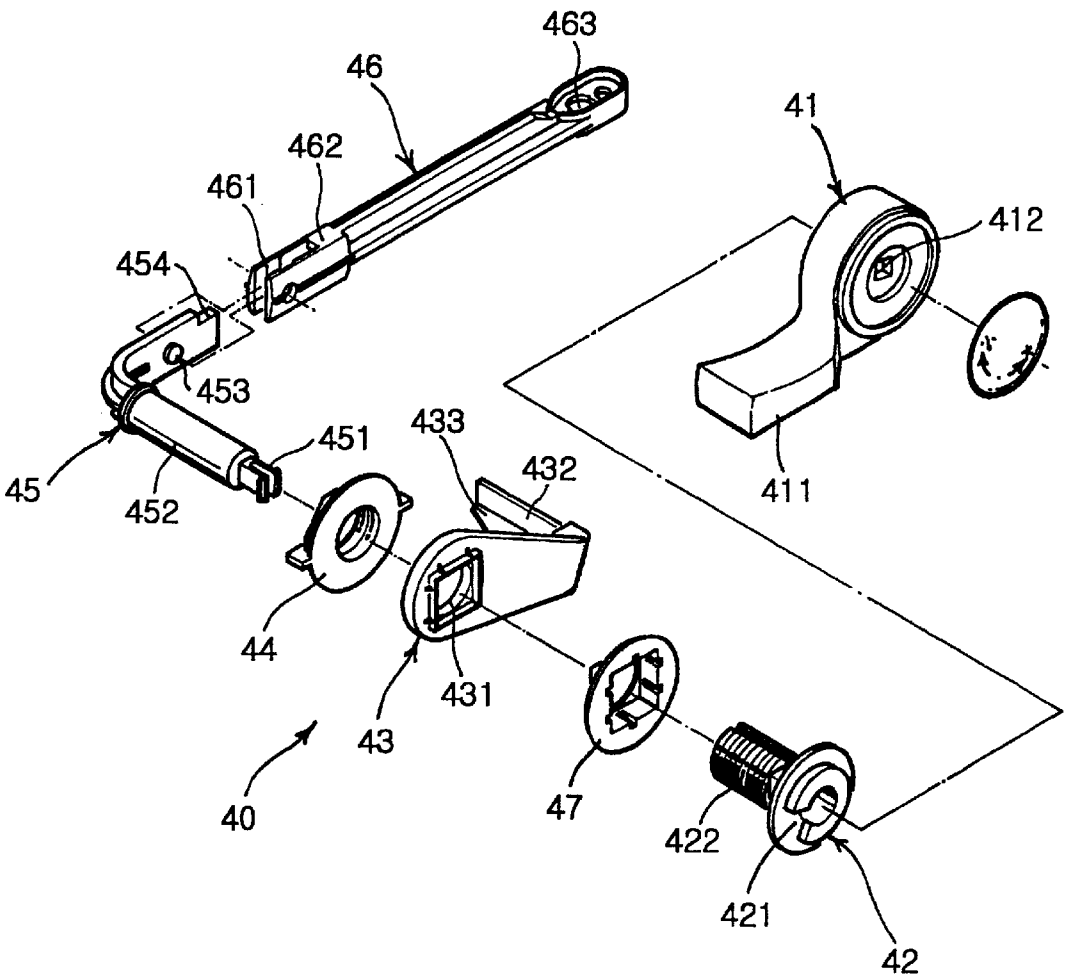
FIG. 2 (PRIOR ART)
FIG. 2 is an exploded perspective view of a device for operating the conventional two-stage drain valve.
Figure 3:
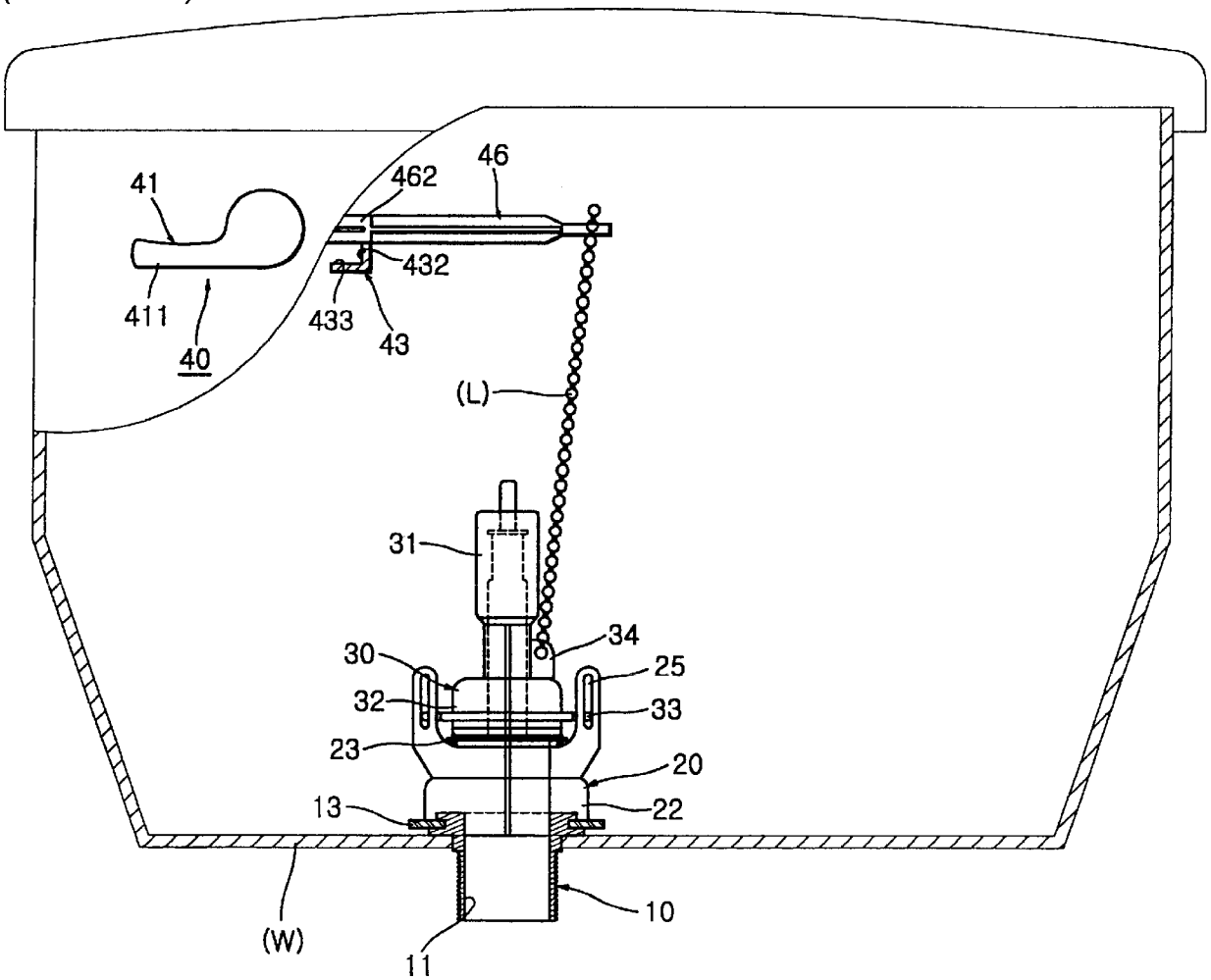
FIG. 3 (PRIOR ART)
FIG. 3 depicts the conventional two-stage drain valve installed in a toilet.
Figure 4A:
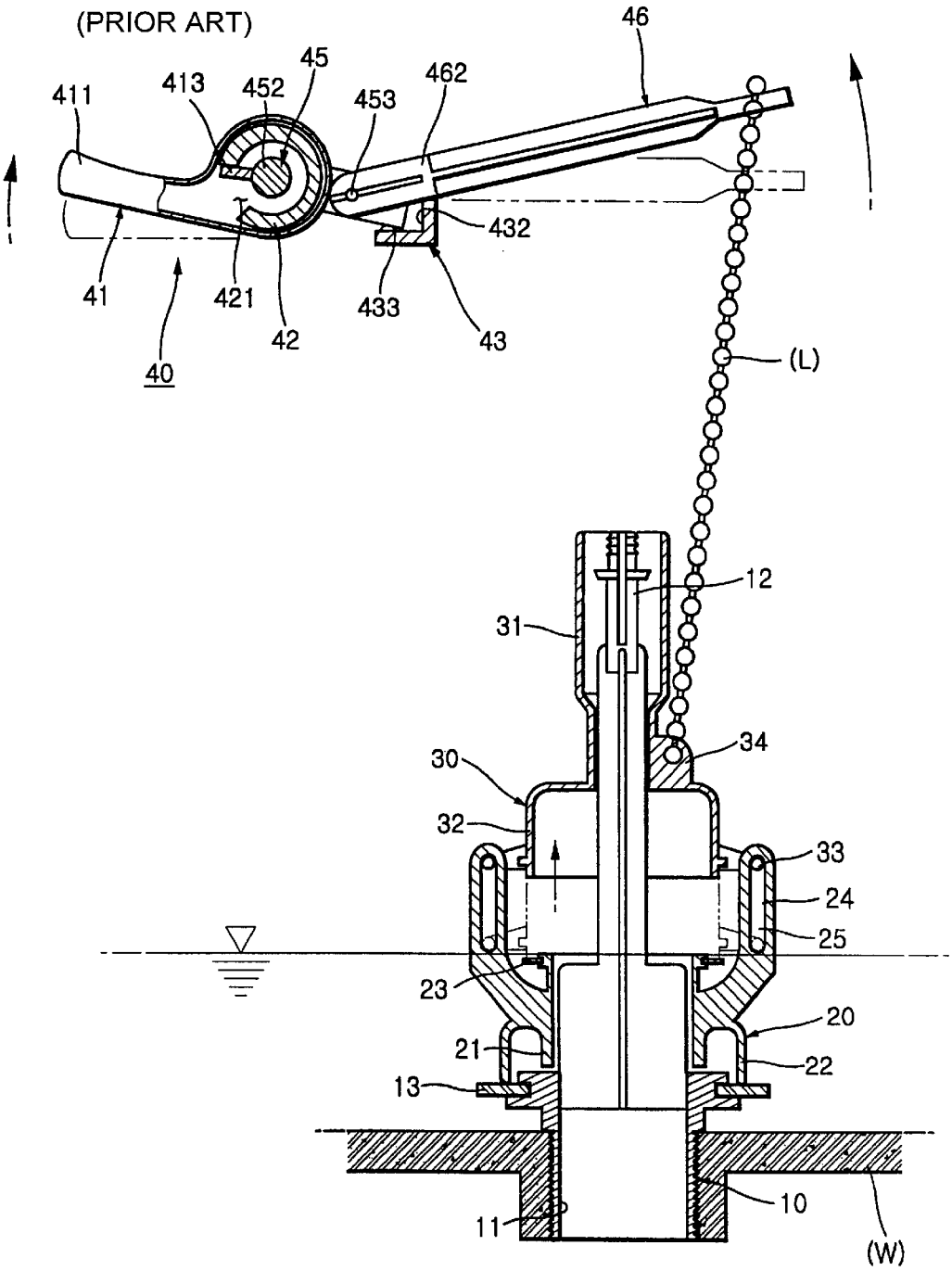
FIG. 4a (PRIOR ART)
Figure 4B:
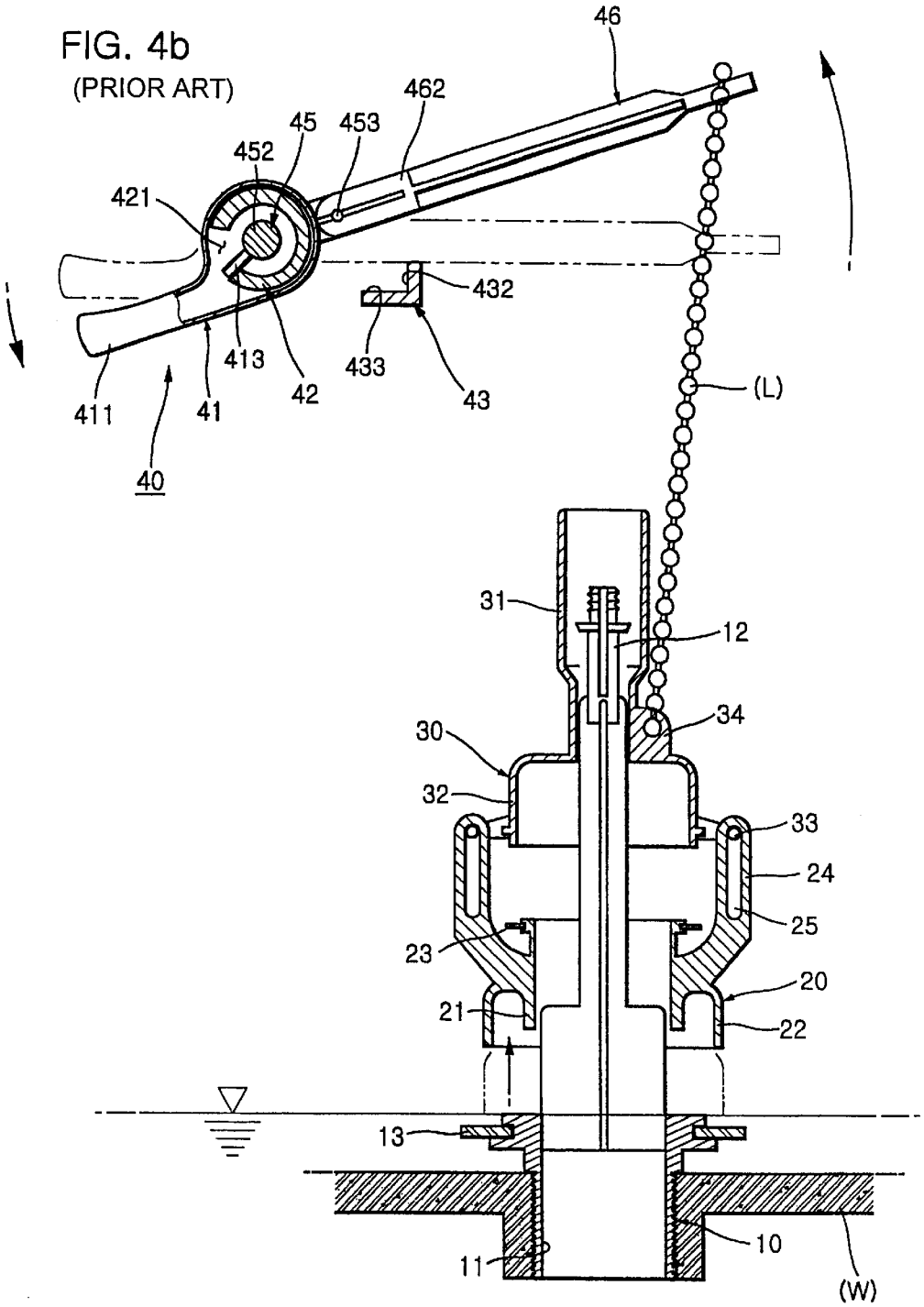
FIG. 4b (PRIOR ART)
Figure 5:
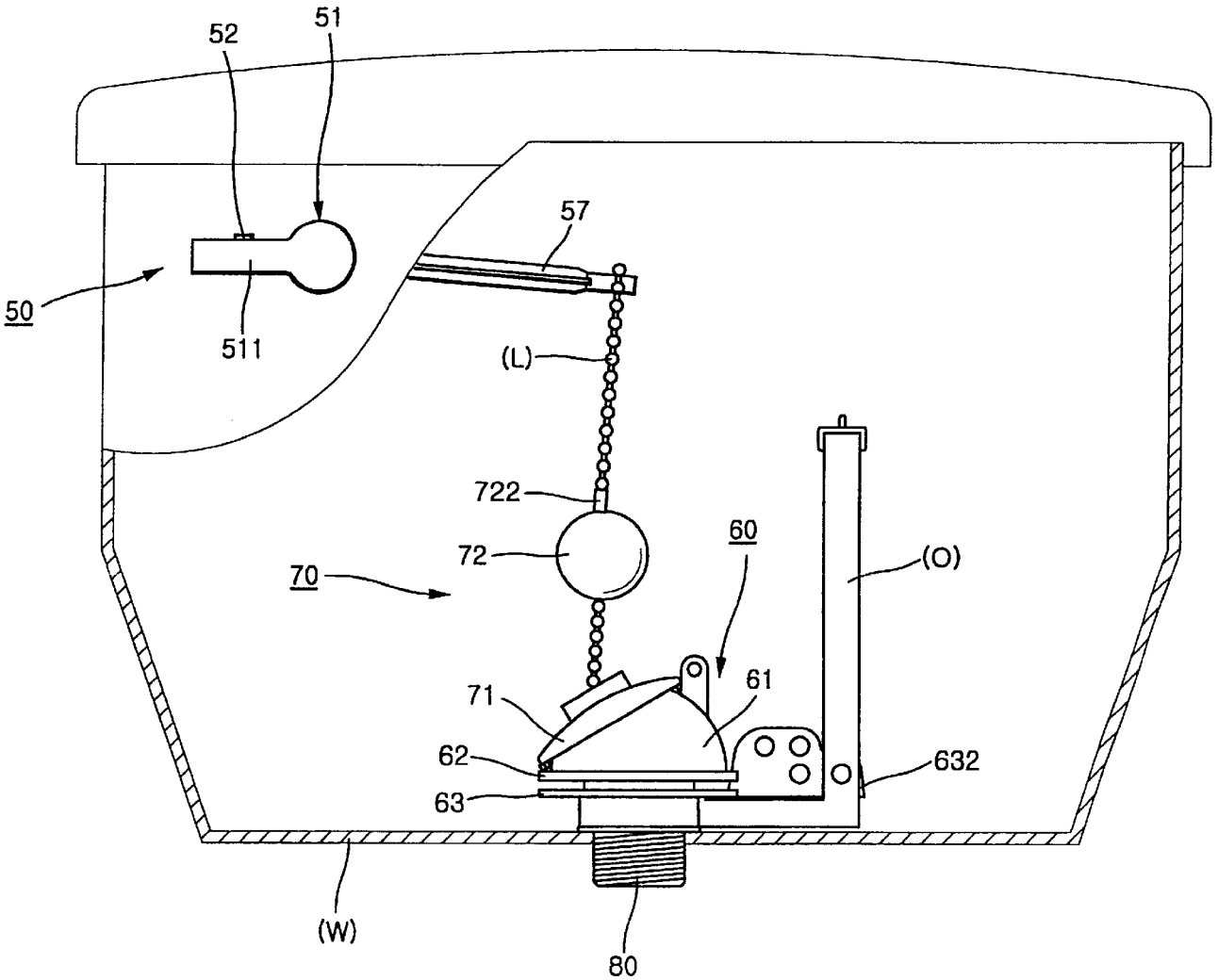

FIGS. 4*a* and 4*b* show the operating state of the conventional two-stage drain valve, and FIG. 4*a* depicts the operating state of the drain valve when a small volume of water drains off while FIG. 4*b* depicts the drain valve when a large volume of water drains off;

FIG. 5 shows a water discharging system in accordance with the present invention.

Figure 6:
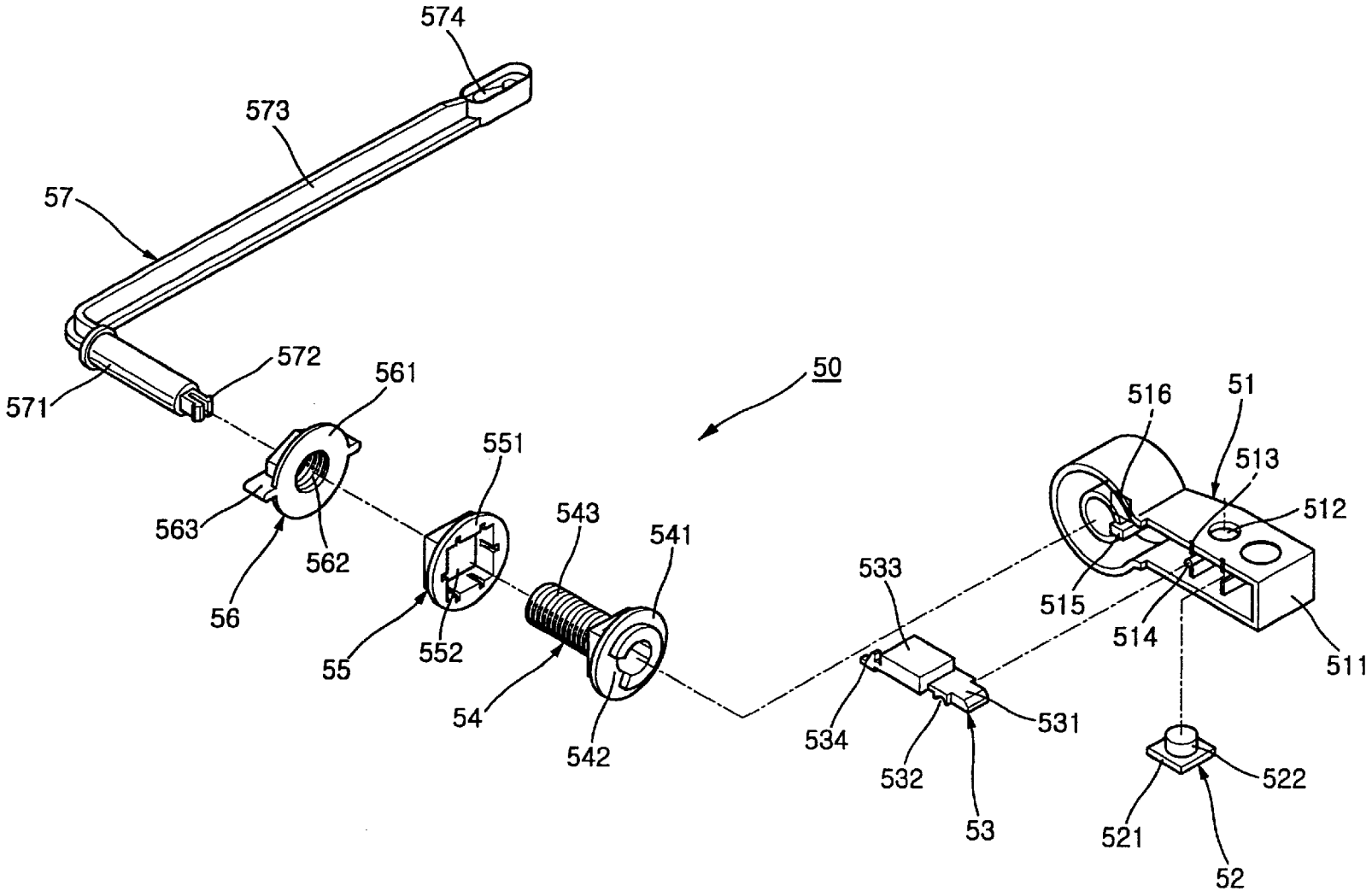
Figure 7:
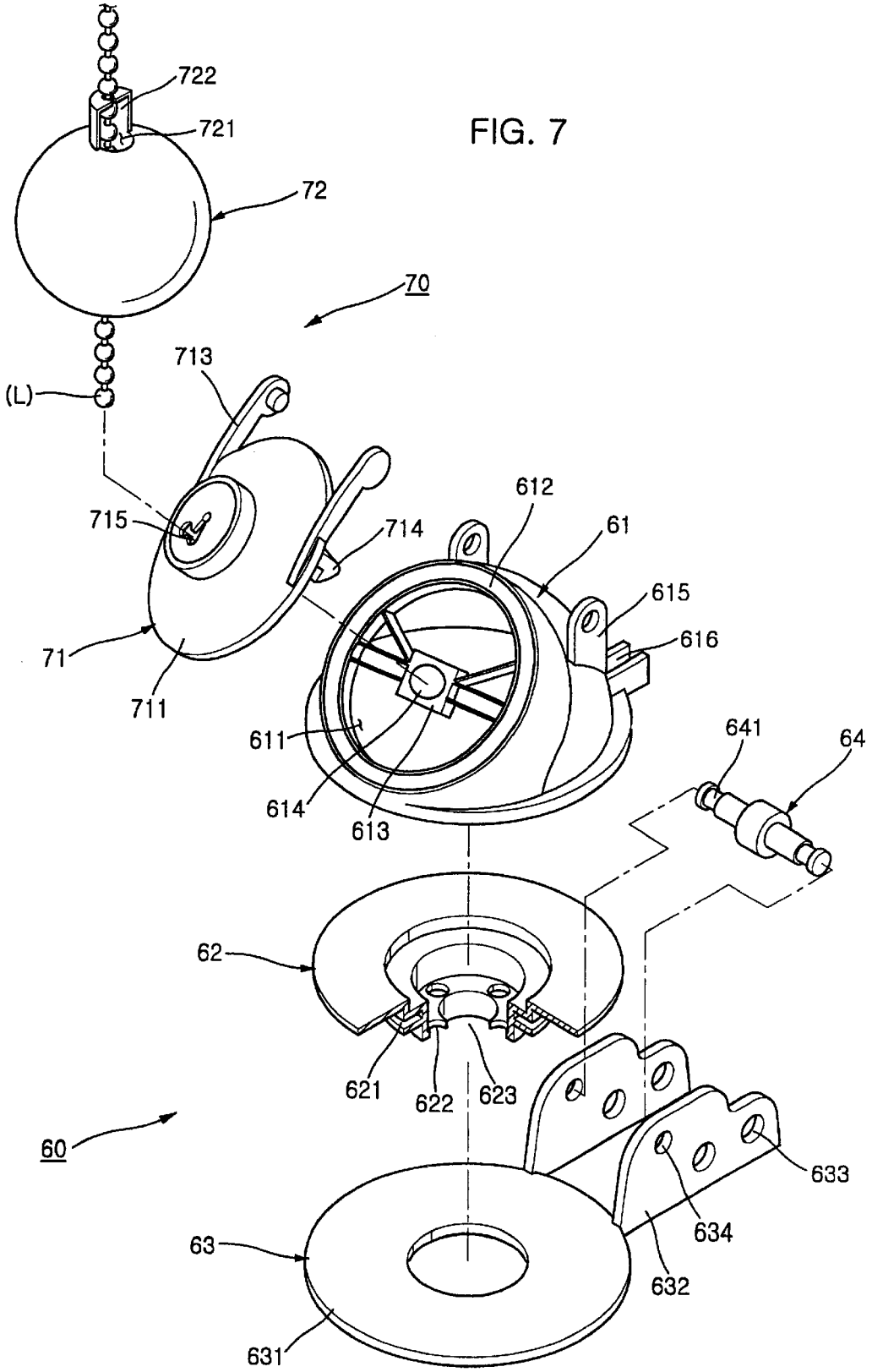
Figure 8A:
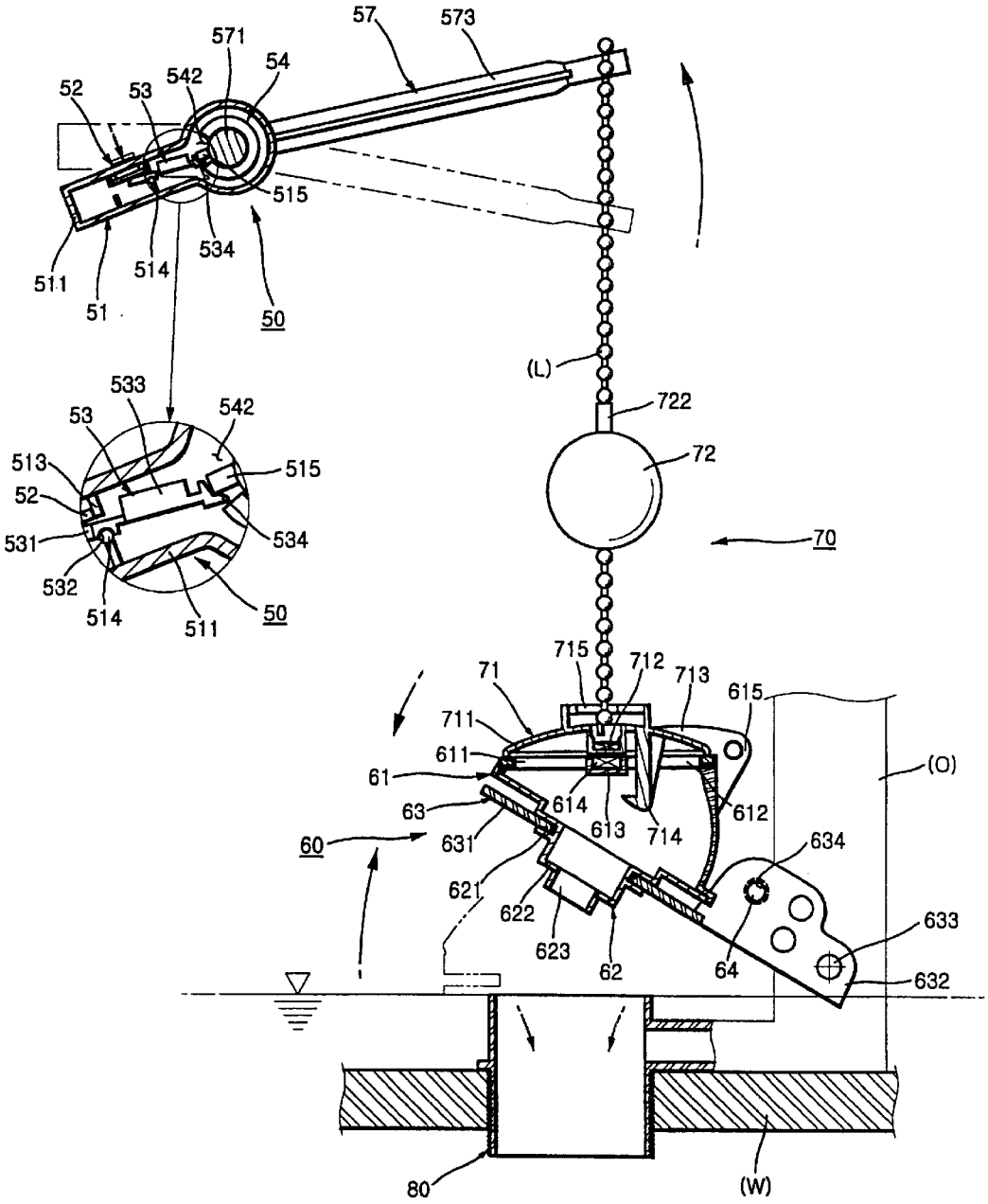
Figure 8B:
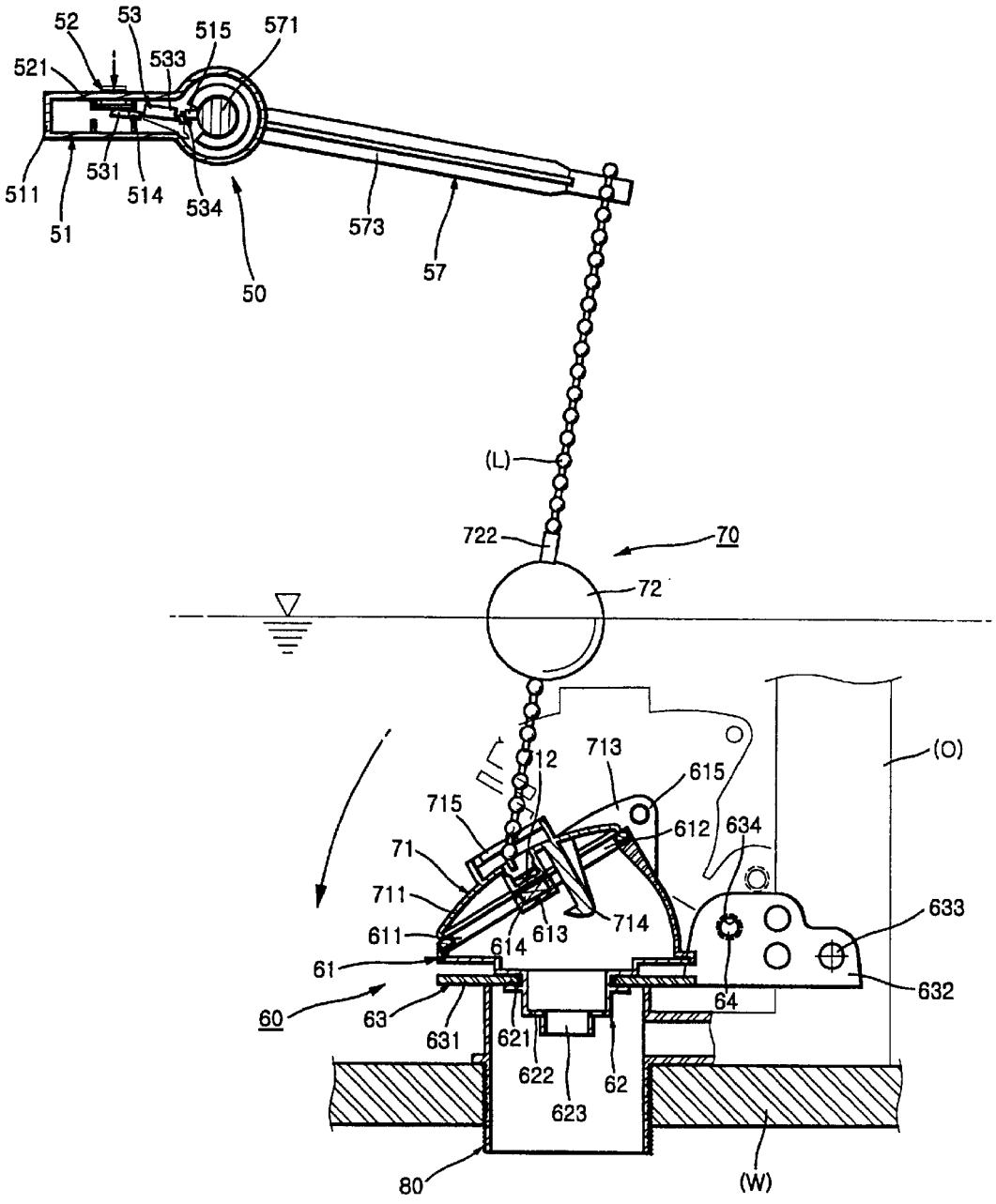
Figure 9A:
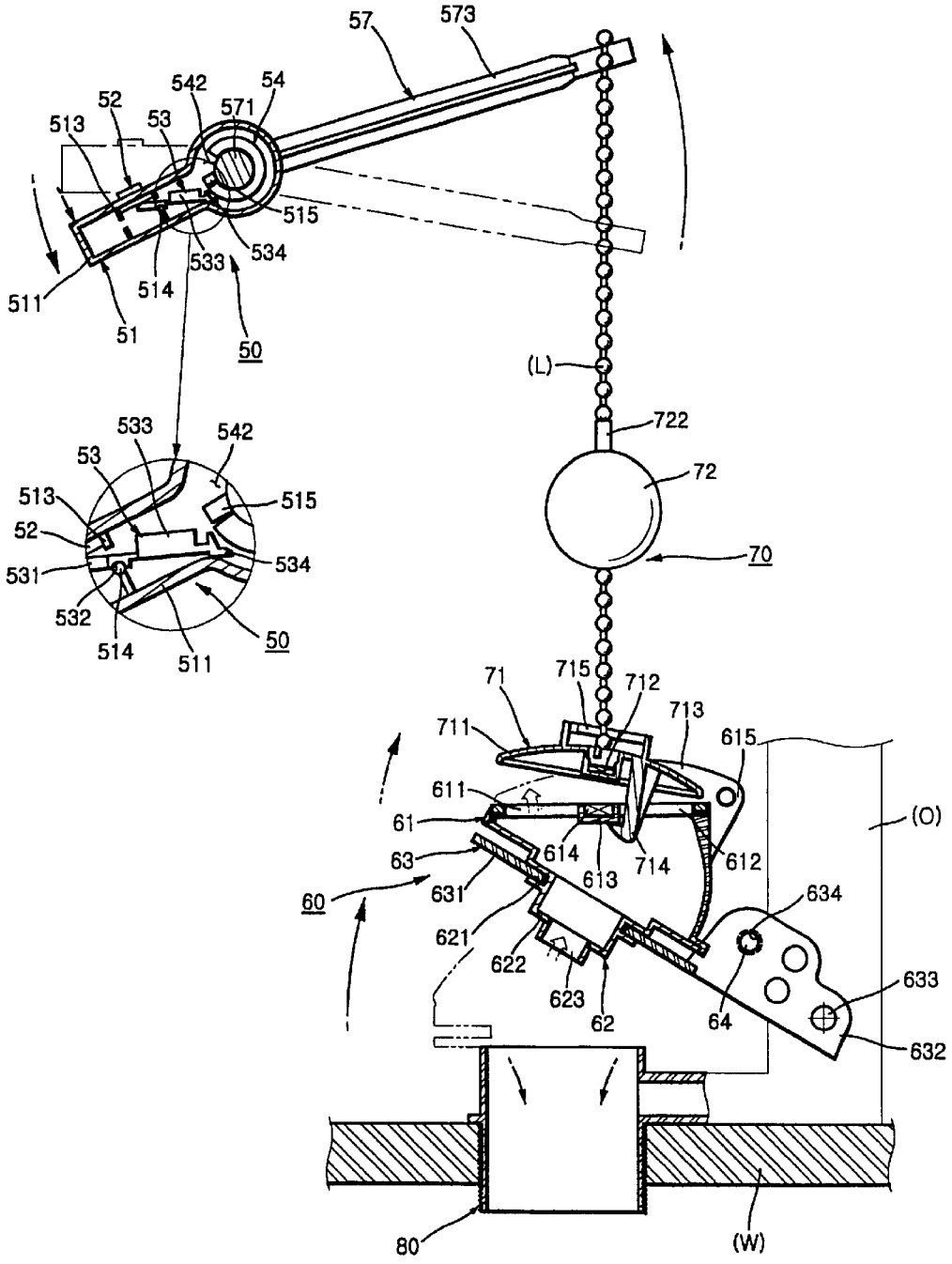
Figure 9B:
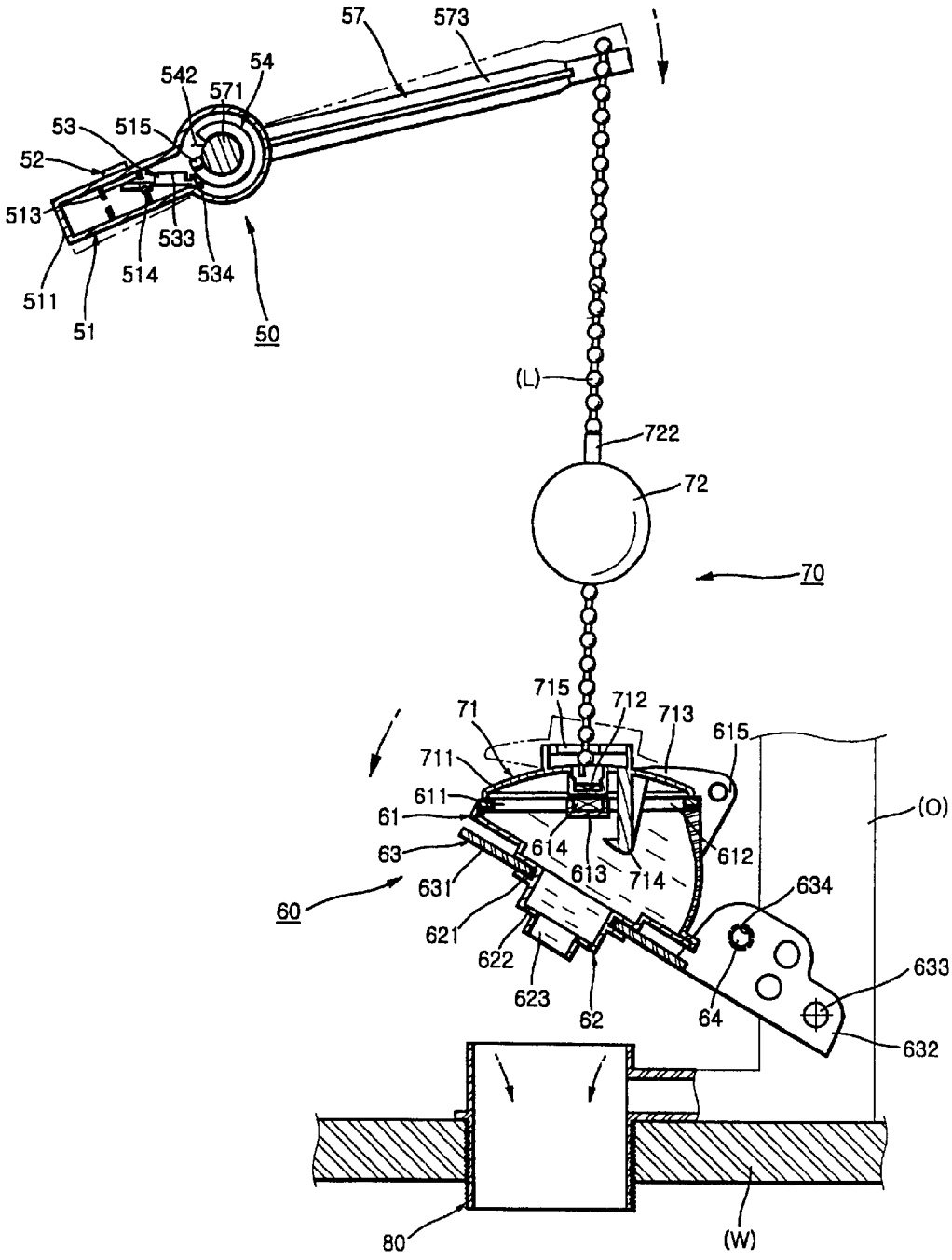
Figure 9C:
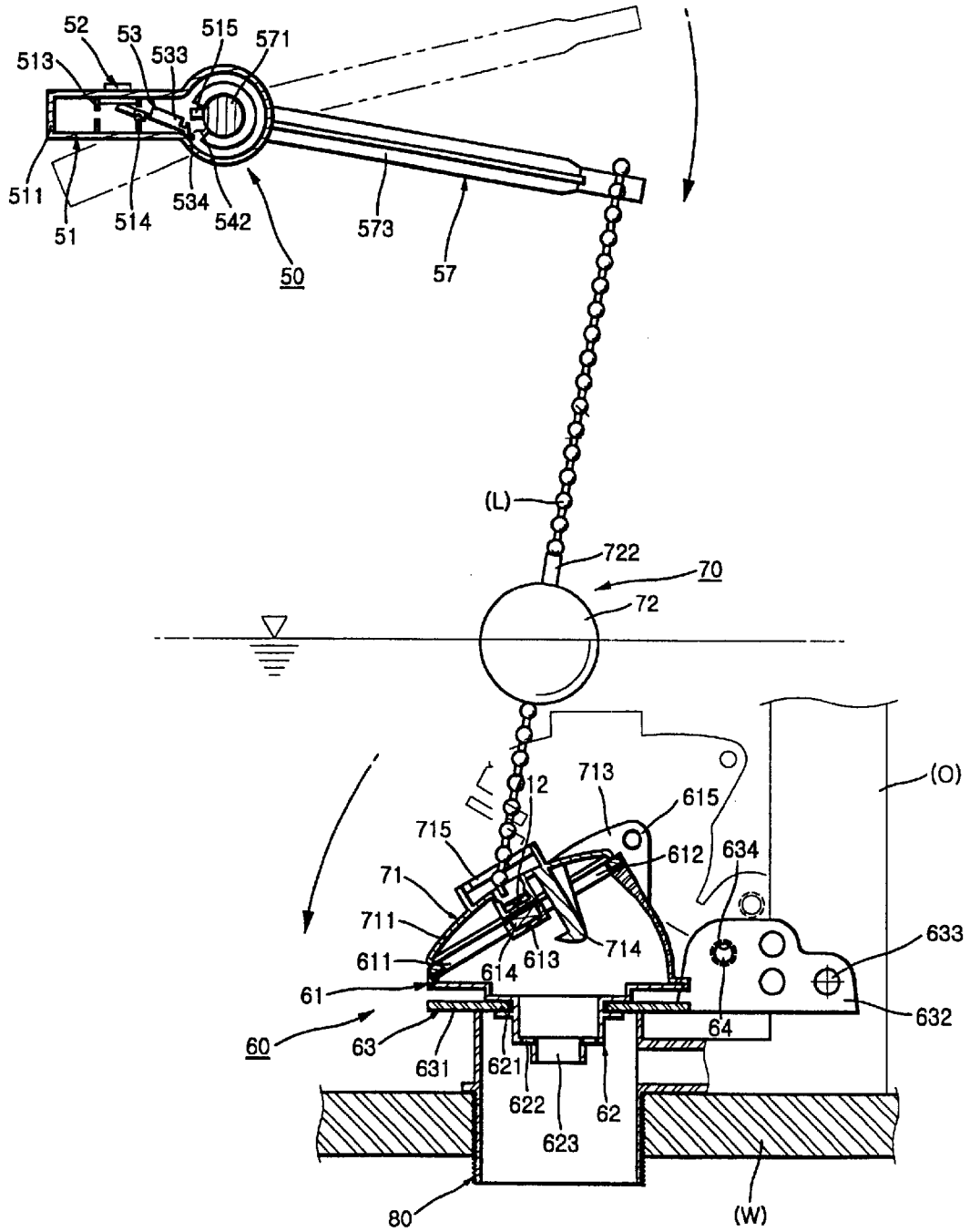

FIG. 6 is an exploded perspective view of an operating part in accordance with the present invention;

FIG. 7 is an exploded perspective view of a flush valve and a buoyancy control part in accordance with the present invention;

FIGS. 8*a* and 8*b* are side sectional views of the water discharging system when a large volume of water drains off in accordance with the present invention; and FIGS. 9*a*, 9*b* and 9*c* are side sectional views of the water discharging system when a small volume of water drains off in accordance with the present invention.

DETAILED DESCRIPTION OF PREFERRED EMBODIMENT

Reference will now be made in detail to the preferred embodiments of the present invention, examples of which are illustrated in the accompanying drawings.

FIG. 5 depicts the inventive water discharging system for a toilet installed in a toilet body.

This water discharging system which can selectively control a volume of water that drains off to wash away the body's waste matter by manipulating a line L connected to an operating lever 51, includes an operating part 50 having an operating member 57 connected with line L, and either operated short by pressing an auxiliary button 52 together with a handle 511 of operating lever 51 or operated long by pushing handle 511 without pressing auxiliary button 52; a flush valve 60 opening a drain pipe 80's intake while the buoyancy of water is maintained if the working distance of line L is short; and a buoyancy control part 70 letting the upper part of flush valve 60 opening drain pipe 80's intake communicate with a water tank W and closing it to remove the buoyancy if line L's working distance is long.

More specifically, operating part 50 includes operating lever 51 installed outside of water tank W selecting a volume of water that drains; auxiliary button 52 protruding to the upper part of operating lever 51 and vertically operated; a control member 53 turned upward and controlling operating lever 51's rotation angle to be small if auxiliary button 52 is moved down; a rotation support member 54 installed on operating lever 51's center of rotation and supporting operating lever 51 to turn by a selected angle; a fixing support member 55 screwed onto rotation support member 54's rear and supporting rotation support member 54 supported by member 55 inside water tank W; and operating member 57 passing through rotation support member 54's inside to the outside and installed integrally in operating lever 51, and moved up to elevate line L if handle 511 of operating lever 51 is moved up.

Operating lever 51 has a square fixing hole 516 on its center of rotation; a stopper 515 extending to the rear on fixing hole 516's one side; handle 511 extending a given distance to one side of the center of rotation; a guide hole 512 formed on the middle of handle 511's upper surface; inner and outer guide pieces 513 each provided to both sides under guide hole 512 to form a guide space of a given width larger than guide hole 512's diameter; and a hinge 514 integrally formed to be spaced a given distance away from inner guide piece 513.

Auxiliary button 52 has a support plate 521 vertically elevated between guide pieces 513 of handle 511, and a circular boss 522 formed on plate 521 and elevated along guide hole 512. Such an auxiliary button 52 is installed by sliding itself between guide pieces 513 inside handle 511 and inserting its circular boss 522 into guide hole 512 formed on the upper surface of handle 511.

Control member 53 has a push plate 531 formed on its rear to correspond to the bottom of button 52's support plate 521; a hinge groove 532 mating with hinge 514; a weight 533 formed on its front heavier than push plate 531 to be moved down by its dead weight; and a catch lug 534 extending from the front end of weight 533's one side. Such a control member 53 is installed by making hinge groove 532 mate with hinge 514 so as to let its catch lug 534 be placed under stopper 515.

Rotation support member 54 has a bolt 543 with an opened center extending a given distance in the rear of a flange 541 of a diameter enough to cover the back of operating lever 51's center of rotation; and a catch groove 542 formed by cutting down one side of flange 541's front surface by a given angle and into which operating lever 51's stopper 515 and catch lug 534 of control member 53, selectively moved up, are inserted.

Fixing support member 55 has a reception hole 552 formed on a disk 551 with a given diameter, slanting to the front, protruding by a height enough to be received in water tank W's hole, and joined to fixing support member 55's front surface.

Check nut 56 has a nut hole 562 formed on disk 561's middle to be screwed onto rotation support member 54, and handles 563 each integrally formed on disk 561's upper and lower parts.

Operating member 57 has a bar 571 freely passing rotation support member 54's middle; a fixing hook 572 provided to bar 571's end and forced into fixing hole 516 formed on operating member 57's center of rotation; a connector 573 bent at right angles and extending from bar 571's rear end; and a plurality of connection holes 574 formed on connector 573's end to be connected to line L's upper end.

Flush valve 60, as shown in FIG. 7, includes a semicircular valve body 61 with an opened lower section having an exhaust hole 611 formed by cutting down valve body 61's upper section slantingly by a given angle from one side to the other lower side, a packing 612 provided to exhaust hole 611's upper circumference, an installation stand 613 provided to exhaust hole 611's middle and radially connecting a plurality of ribs to valve body 61, a magnet 614 mounted on installation stand 613, a pair of shaft stands 615 provided to valve body 61's one rear side, and a pair of support grooves 616 formed under shaft stands 615 extending laterally.

Valve body 61's lower part includes a support member 62 that has an installation groove 621 provided to a second vertical one of three steps formed toward the inner bottom on the middle of a disk whose diameter is the same as an outer diameter of valve body 61's lower part, and a plurality of air intakes 622 formed on a third step to be spaced a given distance away from each other, and an outlet 623 formed on a third vertical section to communicate from the upper part to the lower part. Support member 62 is designed to be joined to valve body 61's opened lower section.

Flush valve 60 also includes a first opening/closing member 63 having a packing 631 with an outer diameter the same as that of valve body 61's opened lower part and a through hole of a diameter the same as installation groove 621 on its middle, a plurality of connection holes 633 formed at one side of packing 631 to be rotatably connected to both sides of an overflow pipe O's lower portion, and a pair of connection pieces 632 each having a fixing hole 634 on its upper portion.

This opening/closing member 63 is tightly fitted into installation groove 621 of support member 62, and installed by making connection holes 633, each formed on connection pieces 632, mate with over flow pipe O's both bosses.

In addition, a stopper 64 has a race 641 at both ends to be inserted in each fixing hole 634 formed on connection pieces 632's upper portion in a manner that stopper 64 is laterally installed between connection pieces 632.

As depicted in FIG. 7, buoyancy control part 70 includes a second opening/closing member 71 having an opening/closing disk 711 of a diameter enough to close flush valve 60's exhaust hole 611, a magnet 712 provided to its bottom center corresponding to flush valve 60's magnet 614, a pair of connection rods 713 each provided to both sides of disk 711's rear arid rotatably connected to shaft stands 615 of flush valve 60, a hook 714 provided to magnet 712's middle rear part extending downward and protruding to the front at its lower end so as to stop second member 71's rotation after magnet 712 is separated from flush valve 60's magnet 614 and caught in installation stand 613's lower part, and a fixing groove 715 formed on disk 711's upper surface to secure line L's lower end. This second opening/closing member 71 is joined to body 51 by rotatably inserting its connection rods 713 into shaft stands 615.

Buoyancy control part 70 also includes a ball-shaped float 72 with a hollow interior having a through hole 721 on its center, and a fixture 722 on its through hole 721. This float 72 is installed by passing line L connected to second opening/closing member 71 via through hole 721 from hole's lower part to upper one, and fixing a given portion of line L to fixture 722. This float 72's height determines the level of water remaining in the water tank when a small amount of the water is discharged.

The following description relates to the operation of the present invention in accordance with a first preferred embodiment.

FIGS. 8*a* and 8*b* are side sectional views of the water discharging system when a large volume of water drains off in accordance with the present invention, and FIGS. 9*a*, 9*b* and 9*c* are side sectional views of the water discharging system when a small volume of water drains off in accordance with the present invention.

In case of washing away feces requiring a large volume of water, once a user pushes auxiliary button 52 of operating lever 51's handle 511, as shown in FIG. 8*a*, support plate 521 of auxiliary button 52 presses control member 53's push plate 531. Push plate 531 is turned downward about hinge 514, and at the same time, its opposite side is turned upward so that catch lug 534 closely contacts stopper 515's lower part. At this point, if the pressure acts on the overall handle 511, handle 511 is turned downward about rotation support member 54, and simultaneously with this, connector 573 of operating member 57 mounted on the center of rotation is rotated upward. When catch lug 534 of control member 53, moved down along with stopper 515 integrally provided to operating lever 51's inside, closely contacts the lower section of rotation support member 54's catch groove 542, operating lever 51 and operating member 57 stop rotating. The angle of each rotation is as large as the remaining space of catch groove 542 receiving stopper 515 and catch lug 534.

Once connector 573 of operating member 57 is moved up line L connected thereto is drawn vertically, and its drawing force is larger than the pressure acting on second opening/closing member 71 and flush valve 60's body 61, and smaller than the magnetic force of each magnet 614 and 712. Accordingly, line L moves up flush valve 60 closed by second opening/closing member 71 and separates first opening/closing member 63 from drain pipe 80's intake, thus draining the water in water tank W to the toilet bowl.

When the pressure is removed from auxiliary button 52, as shown in FIG. 8*b*, control member 53's weight 533, elevated by pushing auxiliary button 52, returns to its lower position by dead weight, and is separated from catch groove 542. Simultaneously with this, connector 573 of operating member 57 is moved down by dead weight, and operating lever 51 returns to its original position. The upper surface of operating lever 51's stopper 515 closely contacts catch groove 542's upper section, and operating lever stops rotating in the opposite direction.

Flush valve 60, supported by overflow pipe O's lower part and moved up, is moved down along the level of the water that drains off with the buoyancy maintained, and closes drain pipe 80's intake after the water required for getting rid of feces is discharged.

In case of washing away the body's waste requiring a small volume of water, such as urine, if a user presses the outer upper surface of operating lever 51's handle 511, as shown in FIG. 9*a*, handle 511 is turned downward about rotation support member 54, and connector 573 of operating member 57 is turned upward. When operating lever 51 rotates and its stopper 515 closely contacts the lower section of member 54's catch groove 542, operating lever 51 and operating member 57 stop rotating.

At this point, catch lug 534 of control member 53 is moved down by weight 533's dead weight and is being separated from rotation support member 54's catch groove 542, so the angle of lever 51's rotation is as large as the remaining space of catch groove 542 receiving stopper 515. Therefore, the angle of lever 51's rotation and that of connector 573's rotation are larger than those of the case where a large volume of water is used.

As operating member 57's connector 573 is turned upward, line L connected thereto is drawn vertically, and its initial drawing force is larger than the pressure acting on second opening/closing member 71 and flush valve 60's valve body 61 closed thereby, and smaller than magnets 614 and 712, thus moving up flush valve 60, closed by member 71, and separating first opening/closing member 63 from drain pipe 80's intake to discharge the water through drain pipe 80.

Sequentially, stopper 64 installed on the front end of first opening/closing member 63's connection pieces 632 is hit by overflow pipe 0 to stop flush valve 60's rotation, and magnet 712 is separated from magnet 614 by the additional drawing force. Once magnet 712 is separated from magnet 614, second opening/closing member 71 is moved up about shaft stands 615 to open flush valve 60's exhaust hole 611, and hook 714 is caught in installation stand 613's bottom, the opening stops.

When flush valve 60's exhaust hole 611 is opened, the internal air flows out through exhaust hole 611, and the water in the water tank is introduced through outlet 623 and air intakes 622 formed on the lower section of support member 62, thus filling water in flush valve 60's valve body 61.

If the user looses hold of operating lever 51's handle 511, as shown in FIG. 9*b*, connector 573 of operating member 57 is moved down by its dead weight, and operating lever 51 returns to its original state. Operating lever 51 closely contacts the upper section of rotation support member 54's catch groove 542, and stops rotating in the opposite direction. As connector 573 of operating member 57 returns to its original position and is turned downward, magnets 614 and 712 are rapidly attached to each other by magnetic force, simultaneously with releasing line L's drawing force, and second opening/closing member 71 returns to its initial state, thereby closing flush valve 60's exhaust hole 611. At this point, flush valve 60's body 61 is filled with water and rapidly moved down without the action of buoyancy.

The step of removing flush valve 60's buoyancy by opening flush valve 60's exhaust hole 611 and the rapid moving-down by closing flush valve 60's exhaust hole 611 are performed by continuous and instantaneous action that presses the overall handle 511 and returns it to its original state without pressing auxiliary button 52 of operating lever 51.

When the level of the water in water tank W approximates to float 72 in the middle of moving down flush valve 60 closed by second opening/closing member 71, flush valve 60 is completely moved down depending on float 72's buoyancy, as shown in FIG. 9*c*, so that first opening/closing member 63's packing 631 closes drain pipe 80's intake. Once drain pipe 80's intake is closed, all the water filled in valve body 61 drains off through outlet 623 formed on the middle portion lower than air intakes 622, simultaneously with introducing the external air through air intakes 622 formed on support member 62's lower section. The level of the water remaining in water tank W approximates to float 72's upper part. Accordingly, the amount of the water that drains off to wash urine away can be selectively determined by float 72's height.

As described above, the inventive water discharging system for a toilet designed to control a volume of water contained in the toilet's water tank W by manipulating short or long the drawing line connected to the operating lever, includes the operating part having the operating member connected with the line and either operated short by pressing the auxiliary button along with the operating lever's handle, or operated long by pressing the overall handle without pushing the auxiliary button; the flush valve opening the drain pipe's intake with the buoyancy maintained if the working distance of the line is short; and the buoyancy control part letting the flush valve's upper part communicate with the water tank and closing the valve to remove the buoyancy if the working distance of the line is long. This water discharging system has an excellent durability and simple structure to be easily installed to a drain pipe of the water tank already provided to a toilet body, and is capable of controlling a volume of water after installation, thus attaining an advantageous economical aspect. In addition, since the water discharging system can control the volume of the water just by turning the operating lever's handle in one direction only, it is convenient to use.

It will be apparent to those skilled in the art that various modifications and variations can be made in the water discharging system for a toilet of the present invention without departing from the spirit or scope of the invention. Thus, it is intended that the present invention cover the modifications and variations of this invention provided they come within the scope of the appended claims and their equivalents.

What is claimed is:

1. A water discharging system for a toilet controlling a volume of water contained in the toilet's water tank for a full or partial flush, said system including an operating lever connected to an operating lever handle for manipulating short or long a drawing line connected to the operating lever, comprising:

an operating part having an operating member connected with the line and either operated short by pressing an auxiliary button on the operating lever handle and simultaneously rotating the operating lever handle, or operated long by rotating the operating lever handle without pushing the auxiliary button;

a flush valve adapted for opening a drain pipe's intake and having a buoyancy therein which is maintained if the line is manipulated short for a full flush; and said flush valve having a buoyancy control part adapted to communicate the flush valve's upper part with the water tank to remove the buoyancy if the line is manipulated long to thereby close the valve after a partial flush.

2. A water discharging system according to claim 1, wherein the operating lever handle extends to one side of a center of rotation and includes a guide hole formed on the middle of the upper surface of the handle, a pair of guide pieces mounted inside the lever handle with each being on opposite sides of and provided under the guide hole to form a guide space of a given width larger than the guide hole's diameter, and a hinge integrally formed on the guide piece closest to the center of rotation so as to be spaced a given distance away from the other of the guide pieces;

the auxiliary button being inserted between the guide pieces of the lever handle and moved up and down along the guide hole;

a control member rotatably seated on the hinge, and having a free end moved up to closely contact a lower section of a stopper formed inside the lever handle if the auxiliary button is pressed and moved down, and said free end being moved down to cause the operating lever handle to rotate at a small angle if the auxiliary button is not pressed;

a rotation support member surrounding the center of rotation and supporting the operating lever so as to limit the angle of rotation between the stopper and the control member;

a fixing support member joined to a rear projecting portion of the rotation support member with the rear projecting portion being adapted to extend into the water tank's interior to support the rotation support member;

a check nut fitting over the fixing support member and adapted to support the fixing support member within the water tank; and an operating member adapted to be disposed within the water tank and connected to the operating lever through the rotation support member such that the operating member turns in a direction opposite to that of the operating lever handle to move the drawing line up.

3. A water discharging system according to claim 2, wherein the control member includes:

a push plate having a rear portion provided with a hinge groove which mates with the hinge and a front portion formed with a weight that is heavier than the push plate so as to be moved down by its dead weight and with a catch lug extending from an outer end of one side of the weight.

4. A water discharging system according to claim 2, wherein the operating member includes:

a bar extending into the rotation support member and having a fixing hook provided on a free end with the fixing hook being forced into a fixing hole formed in the operating lever handle; a connector bent at right angles and extending from a rear end of the bar; and a plurality of connection holes formed on a free end of the connector and adapted to be connected to an upper end of the drawing line.

5. A water discharging system according to claim 1, wherein the flush valve includes:

a semicircular valve body with an opened flat lower section and an arched upper section, the valve body having an exhaust hole provided in the arched section formed by slantingly cutting down the arched section of the valve body by a given angle from an upper high point of the arched section to a lower point adjacent the flat lower section of the valve body, a packing provided to the periphery of the exhaust hole, an installation stand supported in the middle of the exhaust hole by a plurality of ribs that connect the stand to the valve body, a first magnet being mounted on the installation stand, a pair of shaft stands extending upwardly from the arched section of the valve body, and a pair of support grooves extending laterally from a lower end of the shaft stands;

an annular support member provided with a center outlet surrounded by an annular portion forming three steps in vertical cross section, the annular support member having an installation groove provided in the second of the three steps, the annular support member having an outer diameter the same as the outer diameter of the lower section of the valve body, and a plurality of spaced apart air intakes formed on a lateral section of the third of the three steps with the third step forming an outlet at its inner periphery;

a first opening/closing member having a packing with a through hole of a diameter the same as the installation groove and tightly fitted in the installation groove, a pair of connection pieces formed at one side of the packing with each connection piece having a fixing hole on an upper portion, and a plurality of connection holes adapted to be rotatably connected to both sides of a lower portion of an overflow pipe; and an elongated stopper laterally installed between the connection pieces and having both sides ends inserted into each fixing hole.

6. A water discharging system according to claim 5, wherein the buoyancy control part includes:

a second opening/closing member having an opening/closing disk of a diameter sufficient to close the exhaust hole of the flush valve and a second magnet provided on its bottom center so as to correspond to the flush valve's first magnet, a pair of connection rods each provided to both sides of a rear end of the disk and rotatably connected to the shaft stands of the flush valve, a hook extending downwardly from the disk and having a lower end extending laterally toward a front end of the disk so as to stop the rotation of the second opening/closing member after the second magnet is separated from the first magnet of the flush valve and caught in a lower part of the installation stand, and a fixing groove formed on an upper surface of the disk and adapted to secure a lower end of the drawing line; and a ball-shaped float provided with a hollow interior and having a through hole extending through its center adapted to pass the drawing line therethrough, and a fixture surrounding the through hole adapted to fix a given portion of the drawing line.

7. A water discharging system according to claim 6, wherein the float is in the shape of a ball.

* * * * *